United States Patent [19]

Hoffmann

[11] Patent Number: 4,670,864

[45] Date of Patent: Jun. 2, 1987

[54] VOICE INTERRUPTIBLE ALARM DEVICE

[75] Inventor: Harald Hoffmann, Kiel, Fed. Rep. of Germany

[73] Assignee: Braun Aktiengesellschaft, Kronberg, Fed. Rep. of Germany

[21] Appl. No.: 697,373

[22] Filed: Feb. 1, 1985

[30] Foreign Application Priority Data

Feb. 7, 1984 [DE] Fed. Rep. of Germany ..... 3404252

[51] Int. Cl.[4] ..... G10K 11/00; G04B 23/02

[52] U.S. Cl. ..... 367/198; 340/309.15; 368/73

[58] Field of Search ..... 367/197, 198, 199; 381/110; 340/309.15; 368/73

[56] References Cited

U.S. PATENT DOCUMENTS

| | | | |
|---|---|---|---|
| 3,582,671 | 6/1971 | Ott | 367/197 |
| 3,725,602 | 4/1973 | Hoffman | 367/197 |
| 3,784,496 | 7/1973 | Hedin et al. . | |
| 3,855,574 | 12/1974 | Welty . | |
| 4,408,308 | 10/1983 | Smith et al. | 367/197 |
| 4,476,554 | 10/1984 | Smith et al. | 367/197 |

FOREIGN PATENT DOCUMENTS

| | | | |
|---|---|---|---|
| 2853422 | 12/1978 | Fed. Rep. of Germany . | |
| 3111762 | 3/1981 | Fed. Rep. of Germany . | |
| 0035526 | 3/1980 | Japan | 367/199 |
| 1218717 | 1/1971 | United Kingdom | 367/197 |

OTHER PUBLICATIONS

Roginsky, M. L. "Circuit Turns on Tape Recorder Only When Sound is Detected" *Electronic Design,* vol. 23, No. 20, (Sep. 27, 1975), p. 100.

*Primary Examiner*—Ulysses Weldon
*Assistant Examiner*—Ralph Smith

[57] ABSTRACT

An alarm device especially suitable for alarm clocks or timers is described, whose alarm signal can either be interrupted for a certain period of time or shut off by an acoustic signal, for example that formed by the human voice. As a result of its low power consumption, the alarm device according to the invention can also be used in battery-powered devices; when installed in an alarm clock or timer, inexpensive mass production is also made possible by using already existing integrated circuits. The alarm device according to the invention is functional even when the acoustic signal produced by the user is only of very short duration or when the alarm signal is delivered as a continuous tone. Advantageously, the alarm device can also be so designed that it delivers an alarm signal at least for a short time when someone is speaking when the alarm signal is triggered and other noises with frequencies outside the frequency range of fundamental tone of the human voice interrupt or shut off the alarm signal.

19 Claims, 3 Drawing Figures

VOICE INTERRUPTIBLE ALARM DEVICE

The invention relates to an alarm device, especially in an alarm clock or timer, whose alarm signal can be either interrupted for a short time or shut off by an acoustic signal formed by the human voice. Both the interruption of the alarm signal (in alarm clocks, this process is controlled by a "snooze" device) and the shutoff of the signal is accomplished in the alarm device according to the invention independently of the information contained in the acoustic signal, for example by a word, or a series of words in a language.

Such an alarm is known from U.S. Pat. No. 3,855,574. This patent describes an alarm clock with a snooze device, wherein the alarm signal, transmitted by the alarm device at intervals, can be interrupted by an acoustic signal formed by the human voice for a period of time which can be preset (snooze time).

The acoustic signal formed by the human voice is converted by a microphone into an electrical signal and transmitted via an amplifier and trigger circuit to one of the two inputs of a first time switch, whose switching time determines the snooze time. The output signal from a second time switch, whose duration determines the time interval within which an acoustic signal received by the microphone can result in the interruption of the alarm signal, is connected to the second input of the first time switch. The alarm signal itself is generated by a loudspeaker, to which an audio oscillator is connected on the supply side and by a chopper, also connected on the supply side thereof, said chopper making the audio oscillator capable of oscillating or not oscillating (signal duration or pause duration) for specified periods of time. These times are controlled by the chopper itself.

If a sufficiently large acoustic signal strikes the microphone during the pause duration of the alarm signal, the signal which then appears at the output of the amplifier and trigger circuit suppresses continued emission of the alarm signal by virtue of the fact that the first time switch locks the chopper for the snooze period in that state in which the audio oscillator is not capable of oscillating.

An additional expenditure relating to circuit design results from the fact that the device for suppressing the alarm signal must be deactivating during the actual signal emission and reactivated during the pauses in the signal. If the user of the alarm device wants to interrupt it by a short noise, it is possible for him to produce this sound only during the deactivated state, which means that the alarm signal cannot be interrupted and therefore continues to be emitted.

The known alarm device built into a line-operated alarm clock or timer also suffers from the disadvantage that it is continuously in the on position, although it is only required for a few minutes out of the 24 hours. As a result of the associated relatively high power consumption, by comparison to the power consumption required to advance the display device, for example by means of a stepping motor in an alarm clock with an analog display, the known alarm device could not be used in a battery-powered device, especially an alarm clock or timer.

Another disadvantage of the known alarm device is that, despite the above-mentioned shortcomings, it is relatively costly to manufacture from discrete components and is therefore too expensive to be installed in a device that is relatively inexpensive to manufacture by mass production, as for example an alarm clock costing only ten or twenty marks.

SUMMARY OF THE INVENTION

The goal of the invention, therefore, is to provide a voice interruptable alarm device which has the following properties:

(a) low power consumption, so that the alarm device can also be used in battery-powered devices;
(b) functioning ability, even when the acoustic signal produced by the user is of very short duration;
(c) functioning ability, even if the alarm signal is generated as a continuous tone;
(d) usability of already existing integrated circuits for inexpensive mass production of the alarm device.

This goal is achieved by virtue of the fact that a first output of a monoflop is connected to the control input of an integrated circuit of the alarm device which controls the alarm signal, by the fact that the output signal of a rectifier is delivered to one input of the monoflop, to which rectifier a filter and amplifier unit and, ahead of that, a microphone are connected on the supply side, by the fact that the output of the integrated circuit, to which an alarm signal can be delivered, is applied both to an alarm signal converter and to the input of a switching element, whereby the switching element connects the microphone and the filter and amplifier unit to their supply voltage only when an alarm signal coming from the output of the integrated circuit reached its input, and by the fact that an acoustic signal picked up by the microphone changes the monoflop to its unstable state after passing through the filter and amplifier unit and the rectifier, thereby inverting the signal applied to the control input.

In addition, as already discussed in connection with the triggering of the alarm signal, an alarm signal can be generated at least for a short time by the alarm device. The technical solution to this can consist in the fact that the filter and amplifier unit can deliver an output signal only after a certain time has elapsed following application of the supply voltage, this being accomplished by virtue of the fact that a capacitor must first be charged to a certain voltage, so that the operating point of an amplifier contained in the filter and amplifier unit is set.

The alarm device can be designed so that extraneous noises with frequencies that lie outside the frequency range of the fundamental tone of the human voice cannot interrupt or shut off the alarm signal. The technical solution to this is that the filter and amplifier unit contains a lowpass or highpass, which operates above or below the frequency range of the fundamental tone of the human voice.

For additional energy savings, the monoflop can be so designed that it exhibits negligible energy consumption when in its stable state. The technical solution to this can consist in the fact that the monoflop comprises two transistors, both of which conduct only when the monoflop is in the unstable state, while neither transistor conducts while the monoflop is in the stable state.

The alarm device can also be equipped with an illuminating device which illuminates a display device for a certain period of time when the alarm signal generated by the alarm device is interrupted or shut off by the human voice. The technical solution for this can consist in the fact that a second output of the monoflop, which delivers an inverted signal to the first output, is connected to an illuminating device.

BRIEF DESCRIPTION OF THE DRAWINGS

The invention is described in greater detail hereinbelow with reference to an embodiment.

DETAILED DESCRIPTION

Figure 1:
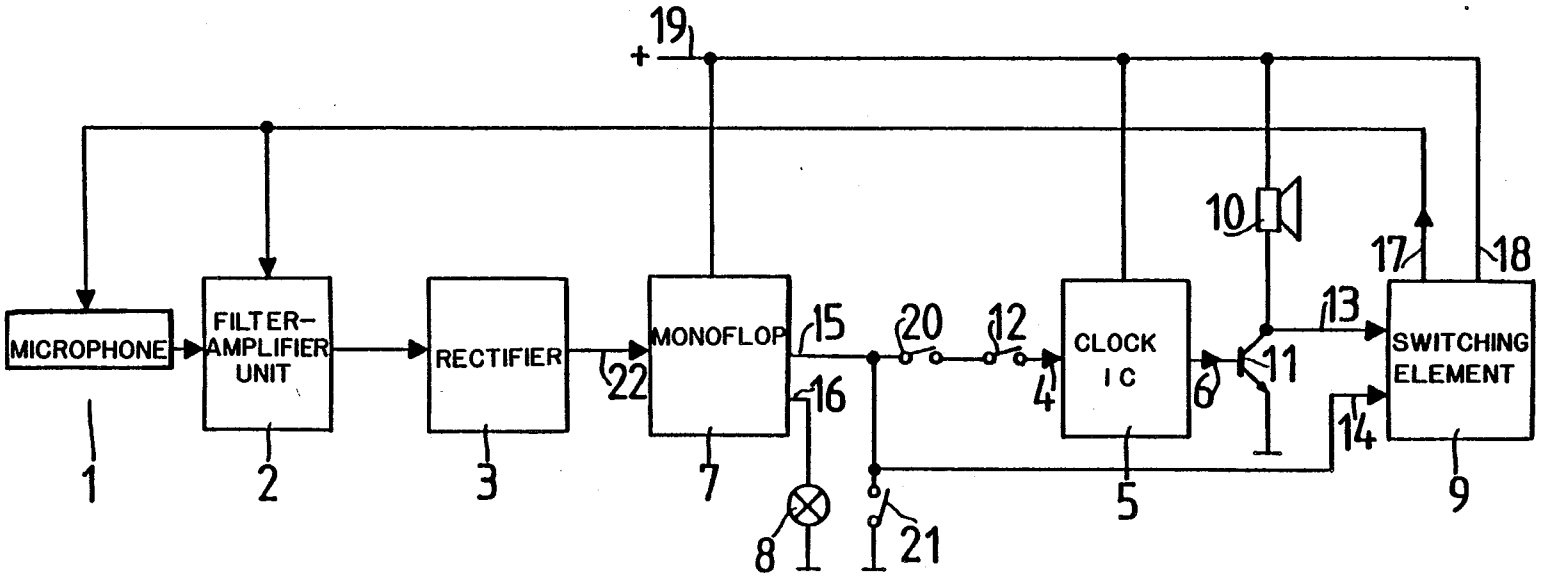
FIG. 1 is a block diagram of the alarm device according to the invention.

In the following, the theoretical operation of the alarm device according to the invention is discussed using the example of an alarm clock or timer with reference to the block diagram shown in FIG. 1:

In FIG. 1, only terminals 4 and 6 of an integrated circuit (IC) 5 are shown, which integrated circuit, in addition to advancing the display device also executes various additional functions in an alarm clock, said circuit having a total of eight terminals. IC 5 is so designed that a continuous pulse train with a frequency in the audible range is emitted at terminal 6 when a signal with a positive voltage level (H signal) is applied to terminal 4. The design of IC 5 can also be expanded in such fashion that the above-mentioned pulse is produced as in intermittent signal with a specific signal-pause ratio at terminal 6.

An alarm triggering switch 12, whose two positions are controlled by an alarm control device not shown here, i.e., in the embodiment by an alarm clock or timer, is connected on the supply side of terminal 4 of IC 5. In addition, an alarm readiness switch 20 is connected on the supply side of terminal 4, said switch 20 being openable and closable manually by the user of the clock, whereby the alarm device is operable only when the switch is in the closed position. If alarm triggering switch 12 is also closed by the alarm control device when alarm readiness switch 20 is closed, a signal from one output 15 of a monoflop 7 is applied to terminal 4 of IC 5. In the stable state, zero potential (L signal) is applied to output 16 of monoflop 7, while an H signal is applied to output 15. Consequently, when monoflop 7 is in the stable state, the pulse train described above is generated at terminal 6 of IC 5, said train serving as a driver signal for an electroacoustic transducer 10 via the base emitter voltage of a switching transistor 11, said transducer 10 being connected between positive terminal 19 of a direct voltage source and ground via transistor 11. Electroacoustic transducer 10 generates a continuous acoustic alarm or wakeup signal or an alarm or signal divided into intervals, with a certain alarm signal frequency depending on whether the driver signal applied to output 6 of IC 5 consists of a continuous or intermittent pulse train.

During the pulsed operation of electroacoustic transducer 10 which contains inductive elements, alternating-voltage peaks with the alarm signal frequency appear at input 13 of a circuit element 9, said peaks being caused by self-induction effects. As a result of these voltage peaks, an input 18 connected to the positive pole 19 of the direct voltage source and an output 17 of switching element 9 likewise connected to switching element 9 are connected electrically with one another. This is necessary before a microphone 1 and a filter and amplifier unit 2 can be connected to the direct voltage source.

Figure 2:
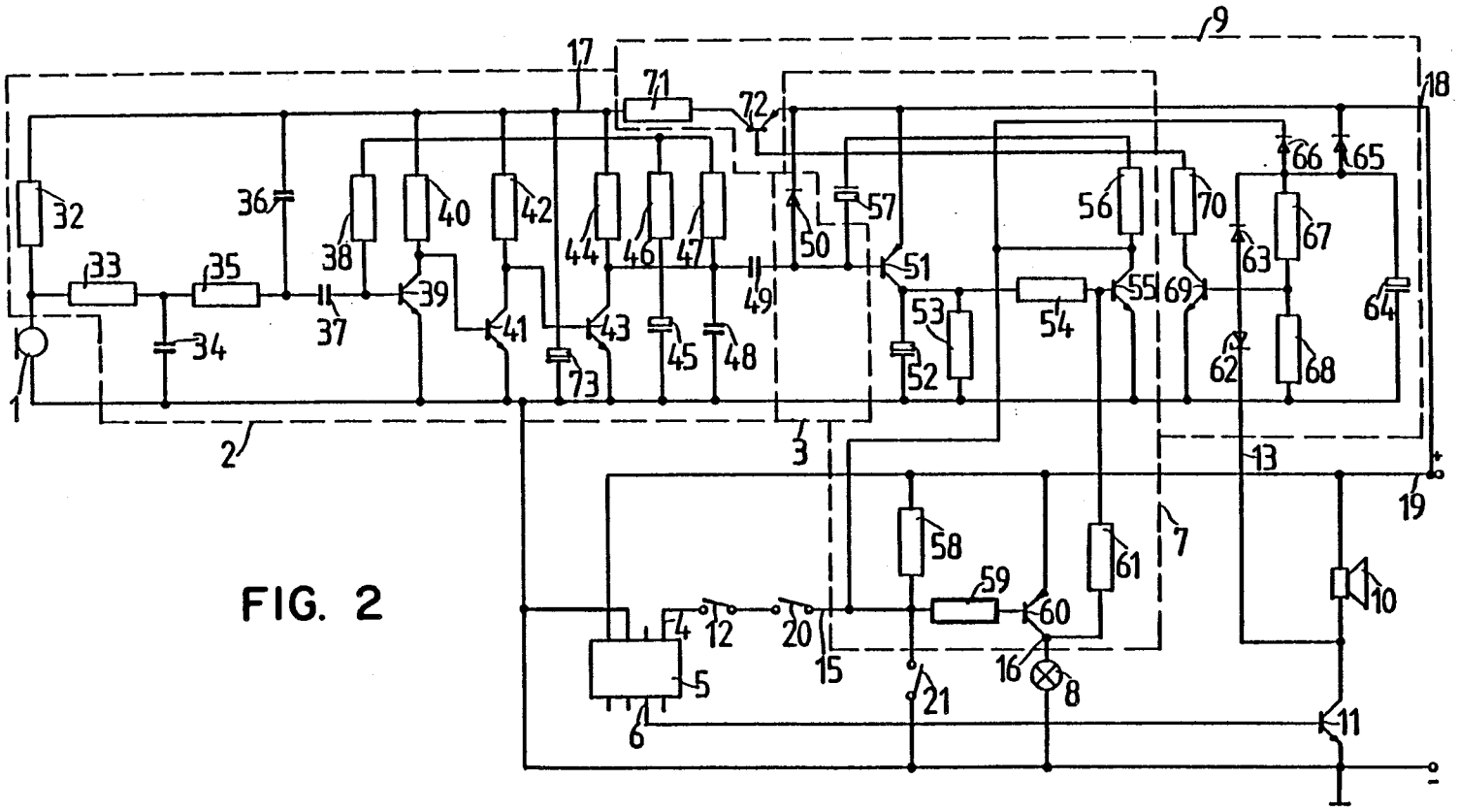
FIG. 2 is a schematic diagram of the embodiment of the alarm device according to the invention.

In addition to the fact that microphone 1 and filter and amplifier unit 2 are connected to the voltge supply only during the period of time the alarm signal is being emitted, additional energy savings are furthered by the fact that monoflop 7, because of its manner of connection (FIG. 2) only shows a non-negligible power consumption when it is in its unstable state.

For further description of the embodiment, without the invention being restricted in any way as a result thereof, we shall proceed on the basis of an IC which, in addition to the control of the display device which it exerts but is not of interest here, for example the stepping motor of an analog display clock, has the following properties:

1. If the line composed of alarm trigger switch 12 and alarm readiness switch 20 is closed and an H signal remains at input 4, an intermittent pulse train with a signal duration of one second, a pause duration of three seconds, and an alarm signal frequency of 2048 Hz will be produced at output 6 for approximately two minutes. The above-mentioned pulse train can only be produced again at output 6 when the above-mentioned line is opened again and then reclosed.

2. On the other hand, if the signal at input 4 changes from H to L before two minutes have elapsed, the pulse train described under 1 above will be interrupted at output 6. After a snooze time of about four minutes, the pulse train described under paragraph 1 above will be delivered again. This so-called snooze process evoked by the changing of the signal from H to L at input 4 can be repeated as often as desired, so long as the line described in paragraph 1 is closed.

In addition to the possibility of opening alarm readiness switch 20 manually, the user can temporarily interrupt the alarm signal by virtue of the fact that acoustic oscillations generated by the human voice and picked up by microphone 1 are amplified in filter and amplifier unit 2, and an output signal is delivered by the latter to a rectifier 3, which in turn is connected to input 22 of monoflop 7. If a sufficiently large signal is applied to input 22, monoflop 7 switches to the unstable state, i.e., an L signal appears at output 15 and an H signal at output 16. As a result, no driver signal for the electroacoustic transducer is applied to terminal 6 of the IC and the alarm signal is therefore interrupted. At the same time, the L signal at output 15 is applied to another input 14 of switching element 9. Switching element 9 is so designed that it interrupts the power supply immediately. The H signal now applied to terminal 16 causes a bulb 8 connected between terminal 16 and ground to light, said light serving to illuminate a display device not shown.

Switching element 9 is so designed that the through connection of the supply voltage to microphone 1 and filter and amplifier unit 2 can last longer, i.e., approximately ten seconds in this case for example, than the alarm signal pause of three seconds lasts in the intermittent alarm signal. This ensures that even during the signal pause in the intermittent alarm signal, microphone 1 and filter and amplifier unit 2 are functional and the alarm signal can be interrupted.

It should also be mentioned that filter and amplifier unit 2 is so designed that, when the supply voltage is applied to it, a rise time of several seconds is needed before a signal coming from microphone 1 can be amplifier at all. This ensures that in any case the alarm device will produce an alarm signal for several seconds, even if someone has already spoken, which is for example the case when a time containing the alarm device according to the invention is used during a meeting.

In addition, filter and amplifier unit 2 is so designed (FIGS. 2 and 3) that the alarm signal frequency of 2048 Hz can be completely filtered out in addition to which noises with a frequency below about 100 Hz can largely be filtered out.

The time during which monoflop 7 remains in its unstable state during its first change of state and during which bulb 8 burns, can be about five seconds. Later changes of state in monoflop 7 are possible at much shorter time intervals because of its circuit (see FIG. 2). It should be mentioned in this connection that the immediate interruption of the power supply by the L signal at input 14 of switching element 9 serves to prevent bulb 8 from being turned on and off several times more when monoflop 7 returns to its stable position and further acoustic signals are picked up by microphone 1. Such switching on and off would entail an undesirably high power consumption.

With the block diagram otherwise unchanged, IC 5 can also be designed so that no snooze process can be triggered and the alarm signal can therefore only be shut off by the human voice. In this case, a signal in the form of a continuous or interrupted pulse train is delivered at output 6 only for a certain period of time, for example for two minutes, if the alarm triggering switch 12 of the alarm clock or timer is closed and therefore an H signal is applied to input 4. If during this time the signal at input 4 changes from H to L as the result of an acoustic signal picked up by microphone 1 or as a result of manual opening of alarm readiness switch 20, the signal at output 6 will be shut off prematurely. When alarm readiness switch 20 is closed, pulse trains will only appear at output 6 when alarm trigger switch 12 of the alarm clock or timer is opened again and then released. This occurs in conventional alarm clocks and timers after 12 or 24 hours.

No alarm triggering switch can be closed mechanically in digital clocks, but a corresponding signal is then delivered when the stored waking time matches the contents of a counter that contains the clock time.

Bulb 8 for illuminating the display device can also be turned on by manually operating pushbutton switch 21 during the period of time in which monoflop 7 is in its stable position. Closing pushbutton switch 21 simultaneously applies an L signal to input 4 of IC 5. Therefore, pushbutton switch 21 can also be used to interrupt or shut off the alarm signal manually.

When alarm readiness switch 20 is closed and after alarm triggering switch 12 is closed, input 4 of IC 5 is connected via resistor 58 to the positive pole 19 of the DC voltage source.

If the above-mentioned alternating voltage peaks appear at input 13 of switching element 9, a capacitor 64 is charged via a diode 63 and a zener diode 62. A n-p-n transistor 69 conducts through two resistors 67 and 68 connected in parallel with capacitor 64, so that a transistor 72 also conducts through an additional resistor 70. A diode 65 connected to terminal 18 and the positive electrode of capacitor 64 limits the voltage to which capacitor 64 can be charged. A capacitor 73 is charged through a resistor 71, connected on the collector side of transistor 72, so that microphone 1 and filter and amplifier unit 2 are supplied with voltage, i.e., the output 17 and input 18 of switching element 9 are connected together through a transistor 72.

The amplifier section of the filter and amplifier unit 2 consists of a three-stage transistorized amplifier in the emitter circuit with three transistors 39, 41 and 43 and collector resistors 40, 42 and 44 whereby the collector of the transistor connected on the supply side is connected in each case with the base of the transistor on the consumer side. In order to adjust the working point of the three-stage transistorized amplifier, the voltage from the collector of transistor 43 is applied to the base of transistor 39 via two resistors 47 and 38 connected in series, resulting in feedback. In order to ensure that only the DC voltage component of the collector voltage from transistor 43 is fed back strongly, a capacitor 45 and a resistor 46 are connected in series between the connecting point of resistors 47 and 38 and the ground of the DC voltage source.

The rise time for filter and amplifier unit 2, which lasts several seconds and has already been mentioned in the description of FIG. 1, is created by virtue of the fact that after the voltage is applied to output 17 of switching element 9, capacitor 45 must first be charged via resistors 44, 47 and 46 to the point where the working point is set and the three-stage transistorized amplifier is therefore operable.

Microphone 1, for example an electric condenser microphone with a built-in impedance converter has one terminal at ground and the other terminal connected via a working resistor 32 to output 17 of switching element 9. The alternating voltage signal generated by microphone 1 is then supplied to the base of first transistor 39 of the amplifier through a filter, whose components 33–37 and operation are described in greater detail hereinbelow in connection with FIG. 3.

As soon as the amplified alternating voltage signal has reached a sufficient amplitude, a capacitor 49 is recharged first by the positive half-wave through a diode 50 in rectifier 3, and secondly during the negative half-wave via the base-emitter diode of a transistor 51.

In the second case, transistor 51 conducts and a cpacitor 52 is therefor charged in stages. At the same time, this capacitor 52 is discharged again through a resistor 53 connected in parallel with it. If more charge flows to capacitor 52 through transistor 51 per unit time than escapes through the resistor, a sufficient voltage will be applied to the base of a transistor 55 which is connected by a resistor 54 to the positive electrode of capacitor 52, then transistor 55 will conduct. By feedback from the collector of transistor 55, which is connected via resistor 58 with the positive pole 19 of the voltage source, the monostable behavior of monoflop 7 is achieved by having a series circuit composed of a resistor 56 and a capacitor 57 to the base of transistor 51.

Therefore, when monoflop 7 is in the stable state, neither transistor 51 nor 55 conducts, while in the unstable state both transistors conduct. Consequently, monoflop 7 exhibits a significant energy consumption only during the comparatively very short period of time that it is in the unstable state.

When transistor 55 conducts, and when alarm readiness switch 20 and alarm triggering switch 12 are closed, an L signal is applied to input 4 of IC 5, thus interrupting or shutting off the alarm signal. On the other hand, capacitor 64 is discharged through a diode 66. This causes the filter and amplifier unit 2 and microphone 1 to be disconnected from the supply voltage. At the same time, transistor 60 conducts through resistor 59, so that bulb 8 lights. Resistor 61, connected between the collector of transistor 60 and the base of transistor 55, improves the switching behavior of monoflop 7 through feedback.

Figure 3:
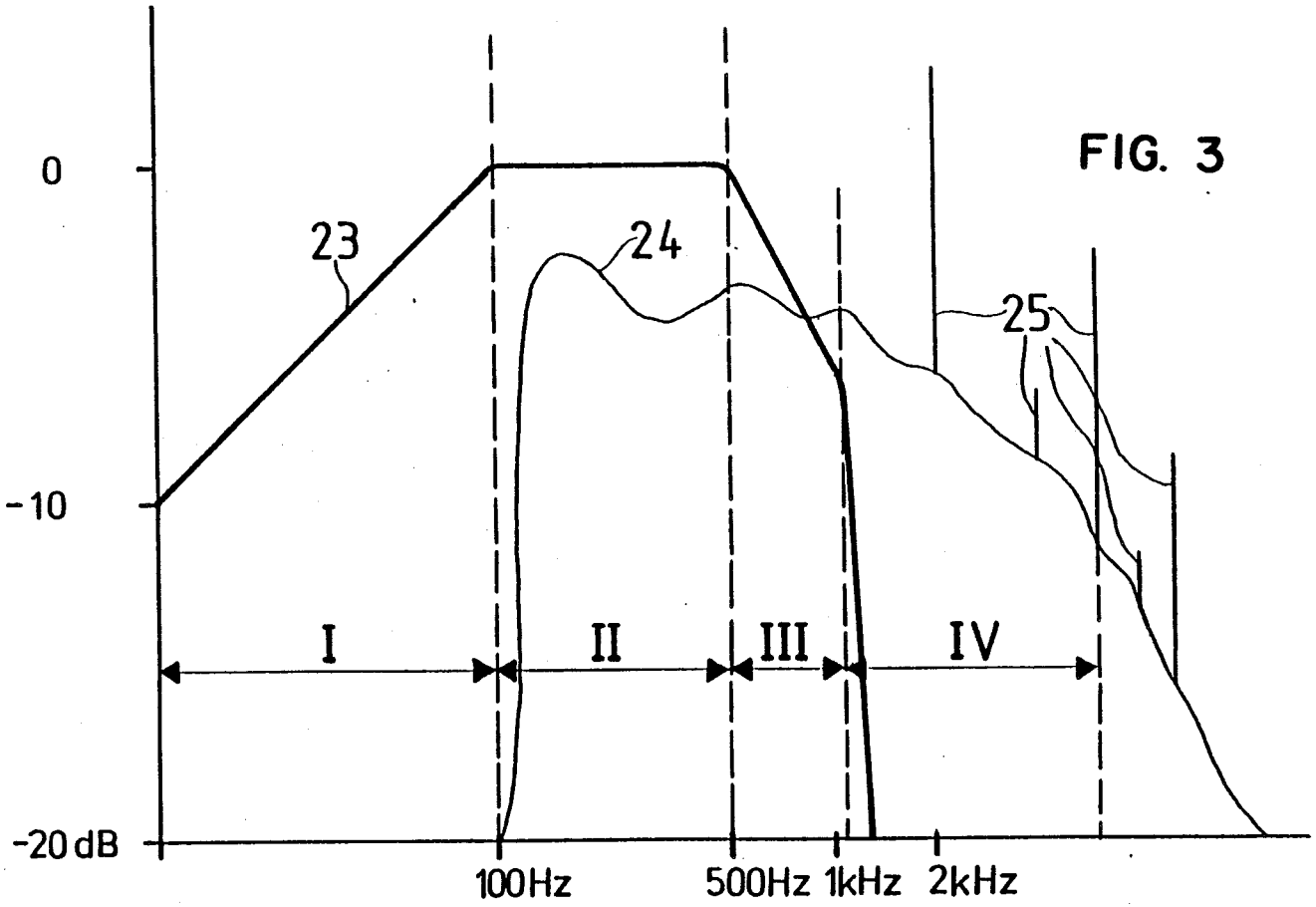
FIG. 3 is the frequency curve of the filter and amplifier device of the embodiment.

FIG. 3 is a schematic respresentation of a spectrum 24 of the human voice with a spectrum 25 of electroacoustic transducer 10 and a filter curve 23 with four ranges I–IV. This filter curve was produced by the filter part of filter and amplifier unit 2.

A resistor 33, connected to the junction between microphone 1 and resistor 32, is also connected with one terminal of a resistor 35. A capacitor 34 is connected to ground between the connecting point of resistors 33 and 35. The other terminal of resistor 35 is connected through a capacitor 36 to input 17 and through a capacitor 37 with the base of transistor 39. Resistors 33 and 35 and capacitors 34 and 36 constitute a two-pole lowpass with a cutoff frequency of about 500 Hz, i.e., this lowpass operates in range III. Capacitor 37 and resistor 38 form a highpass with a cutoff frequency of about 100 Hz, i.e., this highpass operates in range I. In range II, which is located between ranges I and III, and which corresponds to the frequency range of the human voice, there is no signal attenuation. On the contrary, noise outside this range II is attenuated.

An additional filtering action is produced by a capacitor 48, connected to ground from the collector of transistor 43, in such fashion that capacitor 48, when an amplified alternating voltage appears across transistor 43 during the negative half-wave, discharges rapidly, while during the positive half-wave, it is relatively slowly charged through resistor 44. Therefore, a sawtooth voltage appears at capacitor 49, whose amplitude decreaeses about a cutoff frequency as the frequency increases. This sawtooth voltage is no longer sufficient above a frequency of about 1 KHz to drive rectifier 3. Higher frequencies in range IV, as for example the frequency of the electroacoustic transducer can therefore neither interrupt the alarm signal nor shut it off.

The filtering action described with reference to FIG. 3 can also be achieved by a digital filter for the case in which the block diagram shown in FIG. 1 is largely created in the form of an integrated circuit.

While an embodiment and application of the invention has been shown and described, it will be apparent to those skilled in the art that many more modifications are possible without departing from the inventive concepts herein described.

What is claimed to be secured by Letters Patent of the United States is:

1. An alarm device having an alarm signal capable of being interrupted by an acoustic signal generated by a human voice comprising:

a microphone;

an amplifier circuit having a first input terminal connected to said microphone, and a first output terminal;

rectifier means having a first input terminal connected to said first output terminal of said amplifier circuit, and a first output terminal;

monoflop circuit means having a stable state and an unstable state, and a first input terminal connected to said first output terminal of said rectifier means, and a first output terminal;

integrated circuit means having a first control input terminal connected to said first output terminal of said monoflop circuit means, and a first output terminal;

electronic switch meanshaving a first terminal connected to said first output terminal of said integrated circuit means, and a second terminal;

switching elementmeasn having a first input terminal connected to said second terminal of said electronic switch means, a second input terminal connected to said first output terminal of said monoflop circuit means, and a first output terminal connected to said microphone and to said first input terminal of said amplifier circuit;

supply voltage means;

an alarm signal transducer having a first terminal connected to said supply voltage means, and having a second terminal connected to said first input of said switching element means;

said integrated circuit means being connected to deliver said alarm signal by way of said electronic switch means to said alarm signal transducer and to said first input terminal of said switching element means, said switching element means being arranged to electrically connect said microphone and said amplifier circuit to said supply voltage means only when the alarm signal coming from said integrated circuit means appears at said first input terminal of said switching element means, the human voice acoustic signal picked up by said microphone being adapted to change said monoflop circuit means to its unstable state by way of said amplifier circuit and said rectifier means, thereby inverting the signal applied to said first control input terminal of said integrated circuit means and to said second input terminal of said switching element means, whereby said microphone and said amplifier circuit are again disconnected from said supply voltage means, and said alarm signal transducer is turned off, and filter means connected in circuit with said monoflop circuit means for preventing change of state of said monoflop circuit means in response to the output of said alarm signal transducer alone.

2. The alarm device according to claim 1, wherein said amplifier circuit includes said filter means, said filter means comprising a highpass filter and a lowpass filter said highpass and lowpass filters being so dimensioned that they operate below or above the frequency range of the fundamental tone of the human voice.

3. The alarm device according to claim 2, wherein said alarm signal transducer is an electroacoustic transducer that delivers an acoustic alarm signal, the frequency of the acoustic alarm signal lying outside the frequency range of the fundamental tone of the human voice, preferably above one KHz.

4. The alarm device according to claim 1, wherein said amplifier circuit comprises a capacitor, said capacitor having to be charged to a certain voltage before said amplifier circuit will generate an output signal.

5. The alarm device according to claim 1, wherein said amplifier circuit consists of a three-stage transistorized amplifier.

6. The alarm device according to claim 1, wherein said monoflop circuit means comprises two transistors, said transistors both conducting only when monoflop circuit means is in the unstable state, while when said monoflop circuit means is in the stable state, neither of said transistors conduct.

7. The alarm device according to claim 1, wherein said integrated circuit means delivers a train of pulses and said switching element means comprises a delay element, which ensures that when an intermittent alarm signal is generated by the alarm device, said microphone and said amplifier circuit are not immediately disconnected from said supply voltage during the pause between pulses, but remain connected to said supply voltage only so long as the pauses between successive pulses are bridged.

8. The alarm device according to claim 7, wherein said delay element comprises a diode, a capacitor, chargeable by way of said diode, a zener diode, and a resistor, said capacitor discharging through said resistor when there is no alarm signal at said first input terminal of said switching element means, but during the pause between pulses in an intermittent alarm signal, the discharge does not proceed to the point where said supply voltage no longer appears at said first output terminal of said switching element means.

9. The alarm device according to claim 1, and further including a display device and an illuminating device which is turned on for a period of time to illuminate said display device, and wherein said monoflop circuit means includes means for tuning on said illuminating device when the alarm signal generated by the alarm device is interrupted or shut off by the human voice.

10. The alarm device according to claim 9, wherein said monoflop circuit means has an output terminal that is connected to ground through said illuminating device and a non-zero voltage is applied at said output terminal when said monoflop circuit means is in the unstable state.

11. An alarm device having an alarm signal capable of being interrupted by an acoustic signal generated by a human voice comprising:

alarm signal generating means having an alarm signal output terminal, an acoustic response circuit that includes a microphone input terminal, a microphone connected to said microphone input terminal, electronic switch means for applying a enabling signal to said acoustic response circuit, monoflop circuit means having a stable state and an unstable state, said monoflop circuit being connected to apply enabling signals to said alarm signal generating means and said electronic switch means in said stable state, filter means connected in circuit with said monoflop circuit means for preventing change of state of said monoflop circuit means in response to an alarm signal output of said alarm signal generating means alone, means responsive to an alarm signal output of said alarm signal generating means for causing said electronic switch means to enable said acoustic response circuit to respond to an acoustic signal sensed by said microphone, and means responsive to an output of said acoustic response circuit in response to an acoustic signal sensed by said microphone for placing said monoflop circuit in said unstable state, thereby removing said enabling signals from said alarm signal generating means and said electronic switch means, whereby said alarm signal is terminated and said acoustic response circuit is disabled.

12. The alarm device according to claim 11, wherein said acoustic response circuit includes said filter means, said filter means being so dimensioned that it operates below or above the frequency range of the fundamental tone of the human voice.

13. The alarm device according to claim 12, wherein said acoustic response circuit comprises delay means for delaying the generation of said acoustic response circuit output by said acoustic response circuit.

14. The alarm device according to claim 13, wherein said alarm signal generating means includes an electroacoustic transducer that delivers an acoustic alarm signal, the frequency of the acoustic alarm signal lying outside the frequency range of the fundamental tone of the human voice, preferably above one KHz.

15. The alarm device according to claim 11, wherein said acoustic response circuit comprises a capacitor, said capacitor having to be charged to a certain voltage before said acoustic response circuit will generate said acoustic response circuit output.

16. The alarm device according to claim 11, wherein said monoflop circuit means comprises two transistors, said transistors both conducting only when monoflop circuit means is in the unstable state, and neither said transistor conducting when said monoflop circuit means is in the stable state.

17. The alarm device according to claim 11, wherein said alarm signal generating means includes an electroacoustic transducer that delivers an acoustic alarm signal, the frequency of the acoustic alarm signal lying outside the frequency range of the fundamental tone of the human voice, preferably above one KHz, said filter means is in said acoustic response circuit and is dimensioned such that it operates below or above the frequency range of the fundamental tone of the human voice, and said acoustic response circuit comprises delay means for delaying the generation of said acoustic response circuit output by said acoustic response circuit.

18. The alarm device according to claim 17, wherein saidmeans responsive to an alarm signal output of said alarm signal generating means causes said electronic switch means to apply supply voltage to said acoustic response circuit, said alarm signal generating circuit means delivers a train of pulses and said electronic switch means comprises a delay element, which ensures that when an intermittent alarm signal is generated by said alarm signal generating means, said acoustic response circuit is not immediately disconnected from said supply voltage during the pause between pulses, but remains connected to said supply voltage only so long as pauses betwen successive pulses are bridged.

19. The alarm device according to claim 18, and further including a display device and an illuminating device which is turned on for a period of time to illuminate said display device by said monoflop circuit means when the alarm signal generated by the alarm signal generating means is turned off by the human voice.

* * * * *